US011583724B2

(12) United States Patent
Wilson

(10) Patent No.: US 11,583,724 B2
(45) Date of Patent: Feb. 21, 2023

(54) MODULAR FLOOR EXERCISE ASSEMBLY

(71) Applicant: Danny Wilson, Dallas, TX (US)

(72) Inventor: Danny Wilson, Dallas, TX (US)

( * ) Notice: Subject to any disclaimer, the term of this patent is extended or adjusted under 35 U.S.C. 154(b) by 155 days.

(21) Appl. No.: 17/149,212

(22) Filed: Jan. 14, 2021

(65) Prior Publication Data

US 2022/0219038 A1 Jul. 14, 2022

(51) Int. Cl.
*A63B 21/00* (2006.01)
*A63B 23/12* (2006.01)

(52) U.S. Cl.
CPC ..... *A63B 21/4045* (2015.10); *A63B 21/4035* (2015.10); *A63B 23/1236* (2013.01); *A63B 2210/50* (2013.01)

(58) Field of Classification Search
CPC .... A63B 1/00; A63B 3/00; A63B 9/00; A63B 2009/006; A63B 17/00; A63B 17/04; A63B 21/00185; A63B 21/068; A63B 21/4027; A63B 21/4033; A63B 21/4035; A63B 21/4039; A63B 21/4045; A63B 22/20; A63B 22/201; A63B 2022/206; A63B 23/12; A63B 23/1209; A63B 23/1236; A63B 2208/0295; A63B 2210/00; A63B 2210/50; A63B 2225/09; A63B 2225/093
See application file for complete search history.

(56) References Cited

U.S. PATENT DOCUMENTS

| | | | | |
|---|---|---|---|---|
| 2,666,640 | A | 1/1954 | Jennings, Sr. | |
| 3,679,203 | A * | 7/1972 | Grana | A63B 21/00047 482/142 |
| 7,658,702 | B1 | 2/2010 | Harms | |
| 7,662,067 | B2 * | 2/2010 | Payne | A63B 21/00047 482/141 |
| D633,962 | S | 3/2011 | Stacey | |
| 9,327,153 | B2 | 5/2016 | Wallisch | |
| 9,533,189 | B2 | 1/2017 | Cameron | |
| D848,556 | S * | 5/2019 | Bolillo | A63B 26/003 D21/691 |
| D910,127 | S * | 2/2021 | Speas | A63B 23/1236 D21/691 |
| 11,045,679 | B2 * | 6/2021 | Bolillo | A63B 21/00047 |
| 11,219,793 | B1 * | 1/2022 | Weiss | A63B 17/04 |
| 2009/0124471 | A1 | 5/2009 | Storch | |
| 2012/0040811 | A1 * | 2/2012 | DeTore | A63B 23/1236 482/141 |

(Continued)

FOREIGN PATENT DOCUMENTS

WO WO2013177709 12/2013

*Primary Examiner* — Gary D Urbiel Goldner

(57) ABSTRACT

A modular floor exercise assembly for performing floor exercises includes a plurality of floor supports that is each removably attachable together to form a bridge-like structure that can be positioned on a support surface. A pair of cross members is each removably attachable between a respective pair of the floor supports. A handle unit is removably attachable to the cross members when the cross members are attached to the floor supports. Thus, the handle unit can be gripped by a user thereby facilitating the user to perform floor exercises such as a pushup. The handle unit is slidable along each of the cross members to facilitate the user to perform the floor exercises at a variety of different angles with respect to the support surface.

19 Claims, 6 Drawing Sheets

(56) References Cited

U.S. PATENT DOCUMENTS

| | | | | |
|---|---|---|---|---|
| 2012/0258843 | A1* | 10/2012 | Summers | A63B 21/4033 482/93 |
| 2012/0277075 | A1 | 11/2012 | Ho | |
| 2013/0217549 | A1* | 8/2013 | Marji | A63B 21/4035 482/132 |
| 2013/0252790 | A1* | 9/2013 | Sutton | A63B 23/03541 482/131 |
| 2014/0200123 | A1 | 7/2014 | Placide | |
| 2014/0371040 | A1* | 12/2014 | Vasquez | A63B 21/0004 482/39 |
| 2016/0074693 | A1* | 3/2016 | Henry | A63B 21/4033 482/141 |
| 2016/0082313 | A1* | 3/2016 | MacColl | A63B 23/0233 482/141 |
| 2018/0036571 | A1* | 2/2018 | Channer | A63B 21/4035 |
| 2020/0298055 | A1* | 9/2020 | Sneathen | A63B 21/4035 |
| 2021/0178216 | A1* | 6/2021 | Ducato | A63B 23/1236 |

* cited by examiner

MODULAR FLOOR EXERCISE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to modular exercise devices and more particularly pertains to a new modular exercise device for performing floor exercises. The modular exercise device can be disassembled for storage. Additionally, the modular exercise device has a plurality of handle locations for performing the floor exercises with a variety of geometries.

(2) Description of Related Art Including Information Disclosed Under 37 CFR 1.97 and 1.98

The prior art relates to modular exercise devices including a variety of modular exercise devices that are positionable on a floor to facilitate a user to perform floor exercises. In each case the modular exercise devices have handles that are in a fixed location. The prior art discloses a floor exercise device that includes a pair of handles are slidable along concavely arcuate members. In no instance does the prior art disclose a modular exercise device that includes a plurality of handles that are positionable at various locations.

BRIEF SUMMARY OF THE INVENTION

An embodiment of the disclosure meets the needs presented above by generally comprising a plurality of floor supports that is each removably attachable together to form a bridge-like structure that can be positioned on a support surface. A pair of cross members is each removably attachable between a respective pair of the floor supports. A handle unit is removably attachable to the cross members when the cross members are attached to the floor supports. Thus, the handle unit can be gripped by a user thereby facilitating the user to perform floor exercises such as a pushup. The handle unit is slidable along each of the cross members to facilitate the user to perform the floor exercises at a variety of different angles with respect to the support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
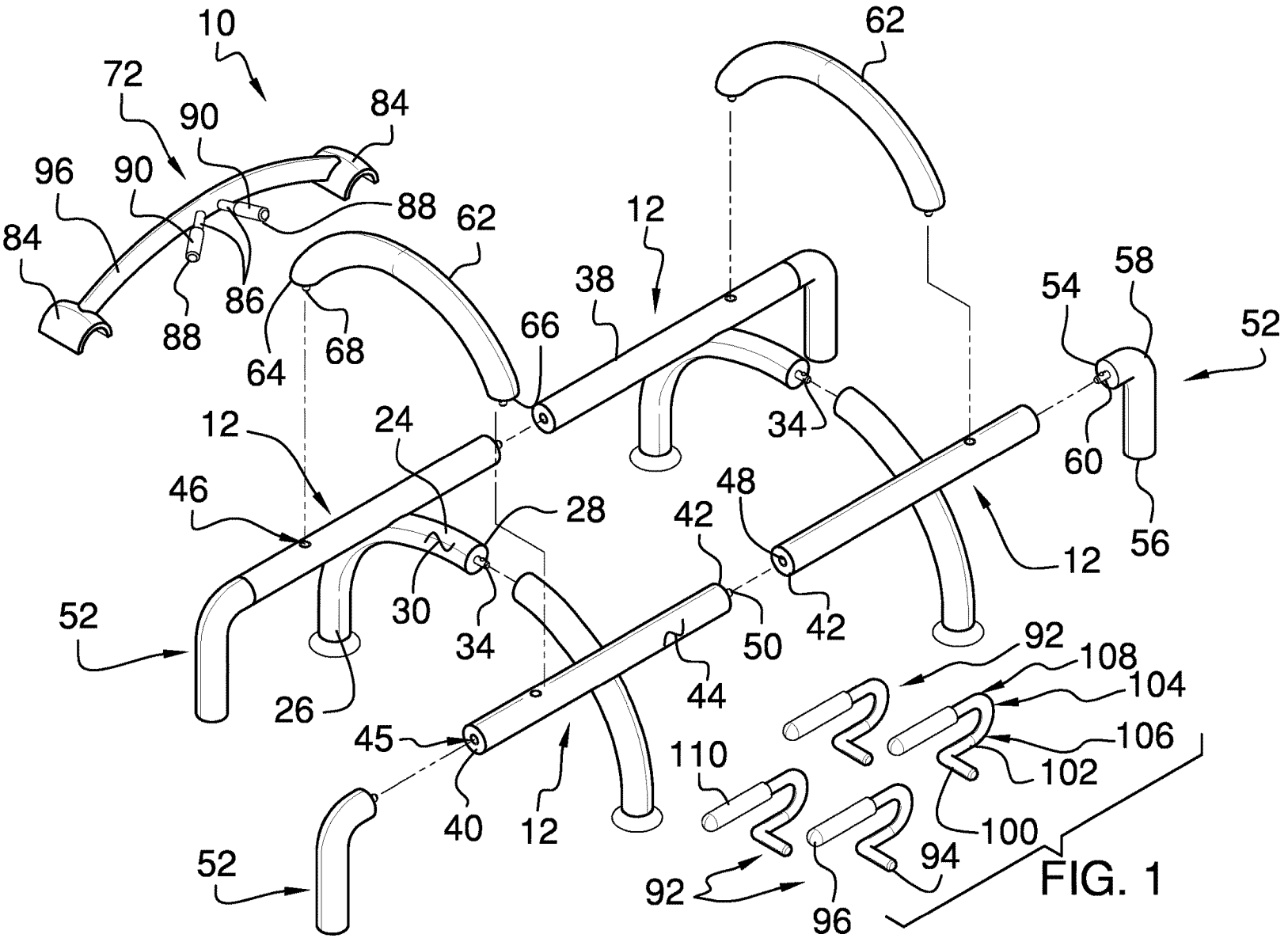
FIG. 1 is an exploded perspective view of a modular floor exercise assembly according to an embodiment of the disclosure.
Figure 2:
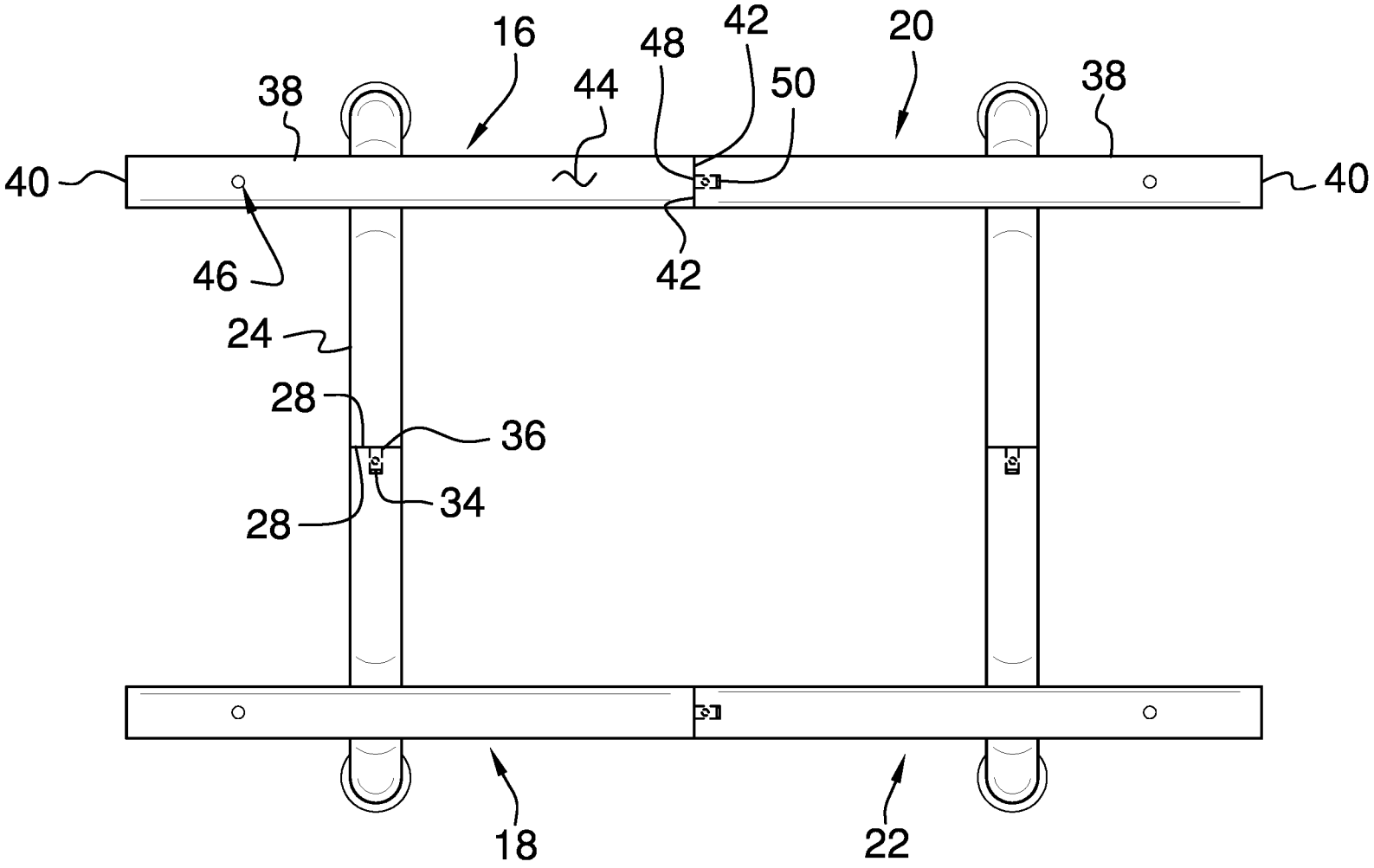
FIG. 2 is a top view of an embodiment of the disclosure.
Figure 3:
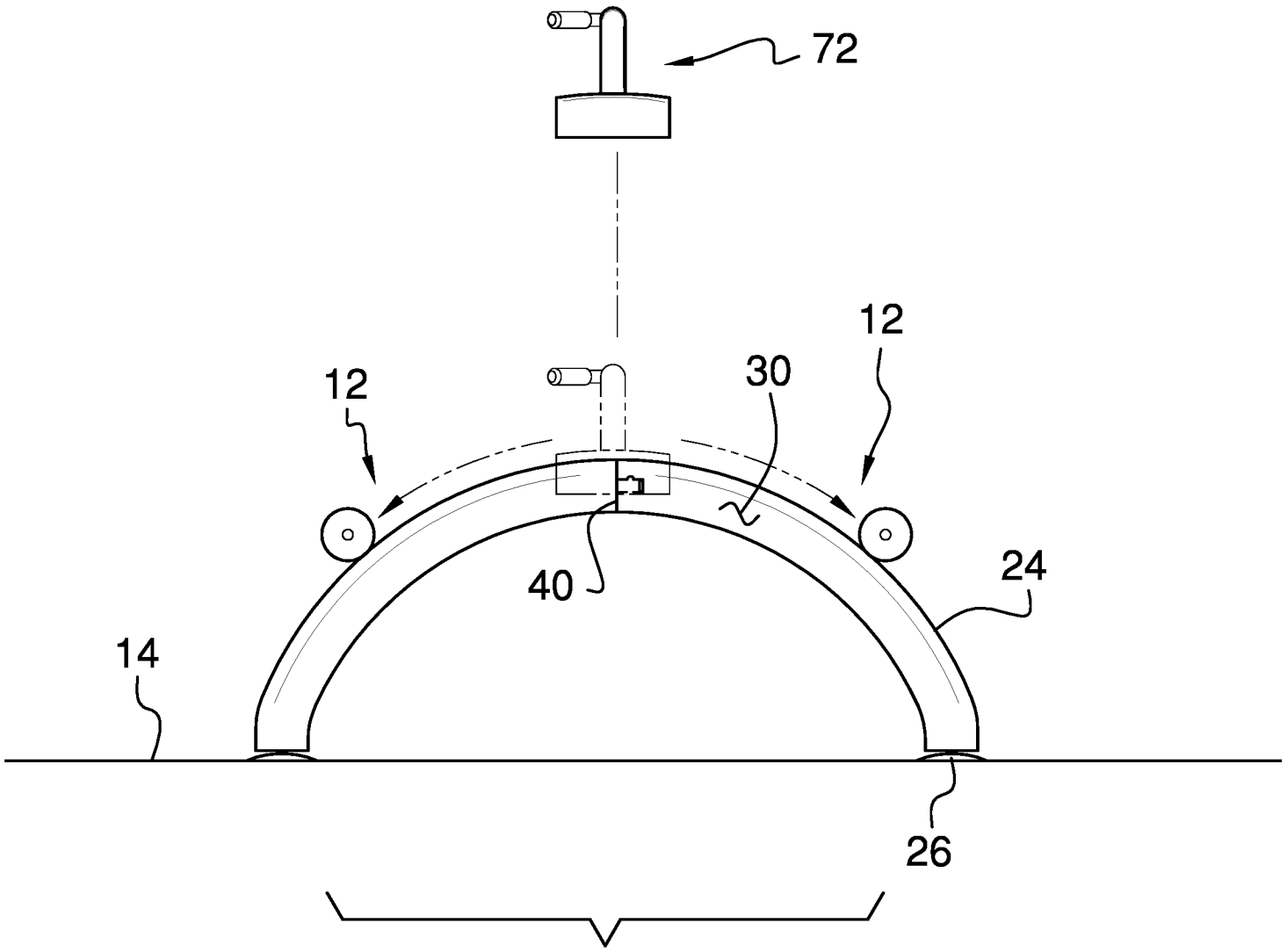
FIG. 3 is a left side view of an embodiment of the disclosure.
Figure 4:
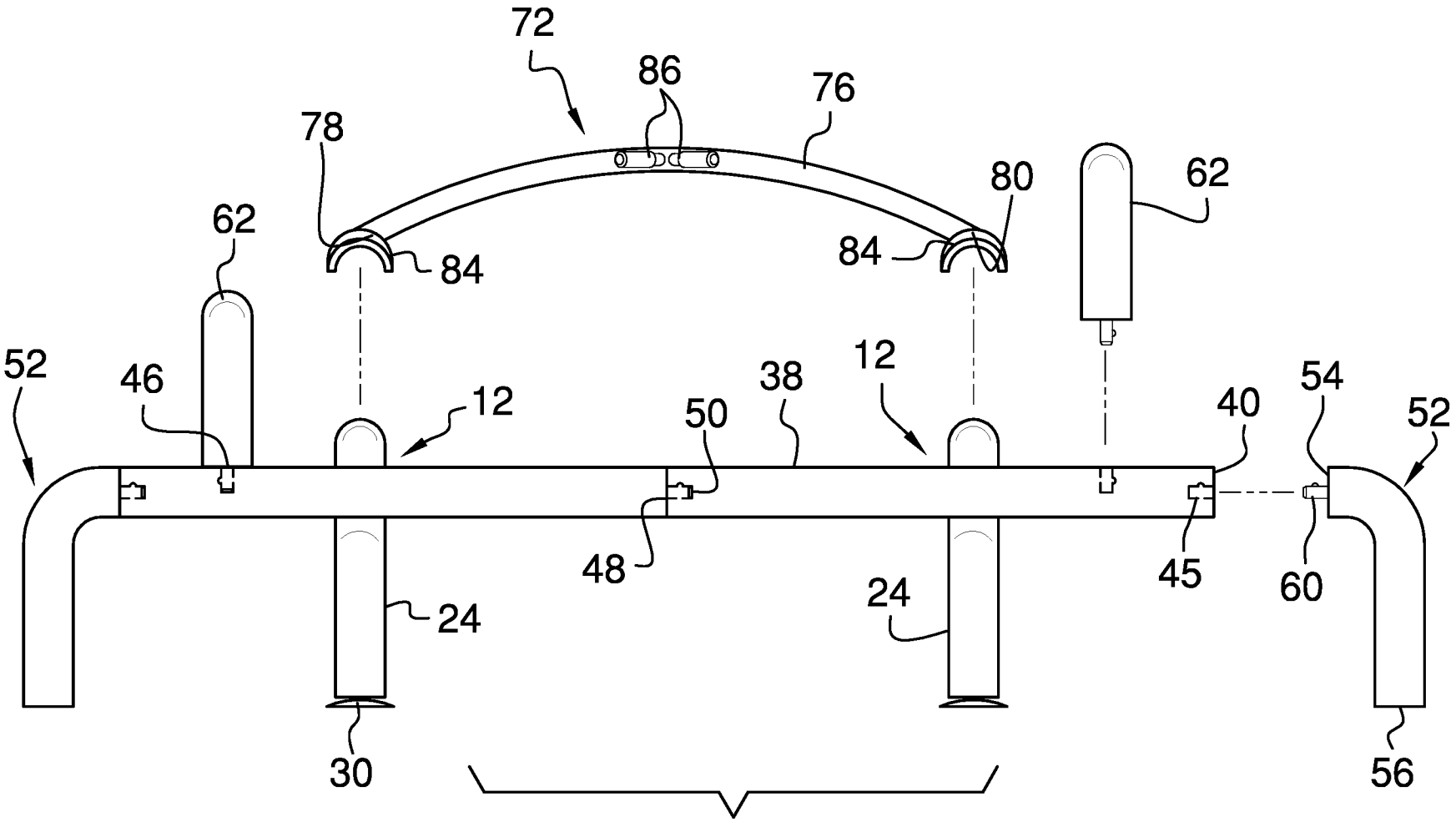
FIG. 4 is a front exploded view of an embodiment of the disclosure.
Figure 6:
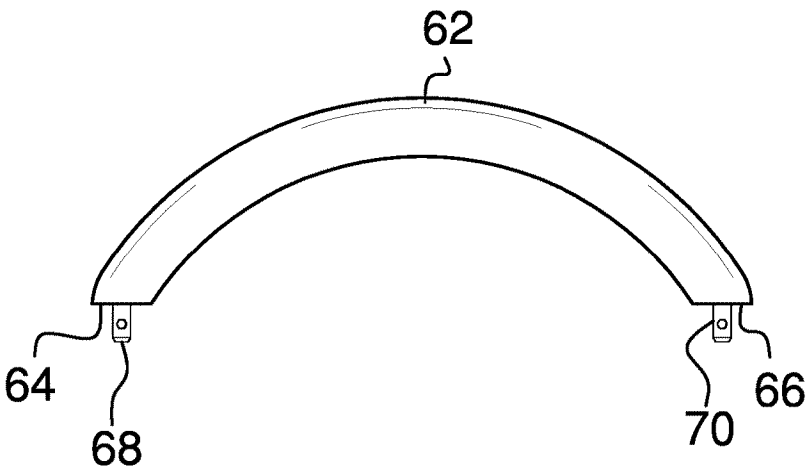
FIG. 6 is a front view of a curved member of an embodiment of the disclosure.
Figure 5:
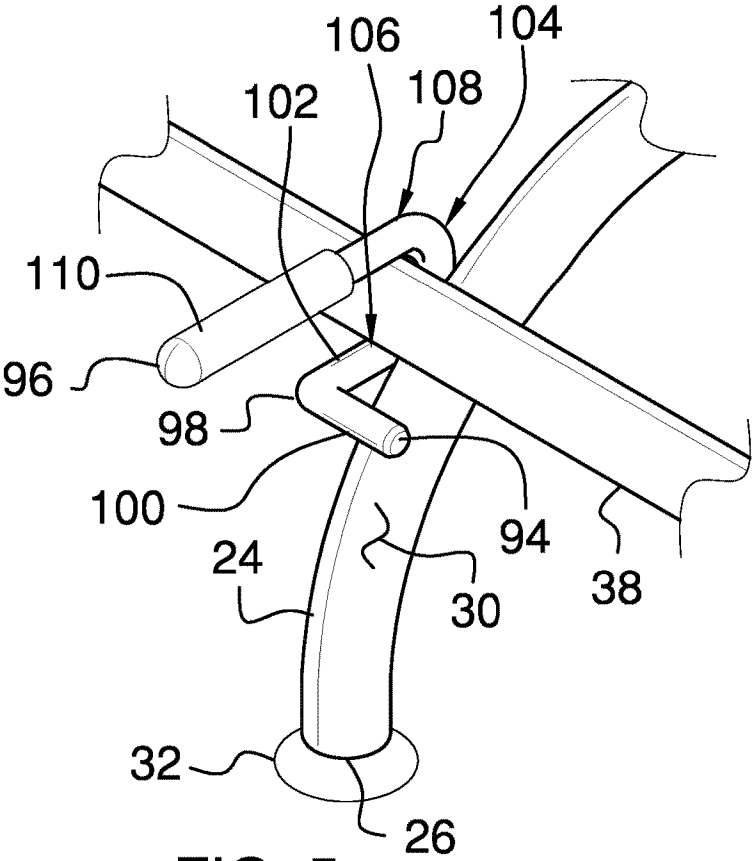
FIG. 5 is a detail view of an auxiliary handle being positioned around an elongate member of an embodiment of the disclosure.
Figure 7:
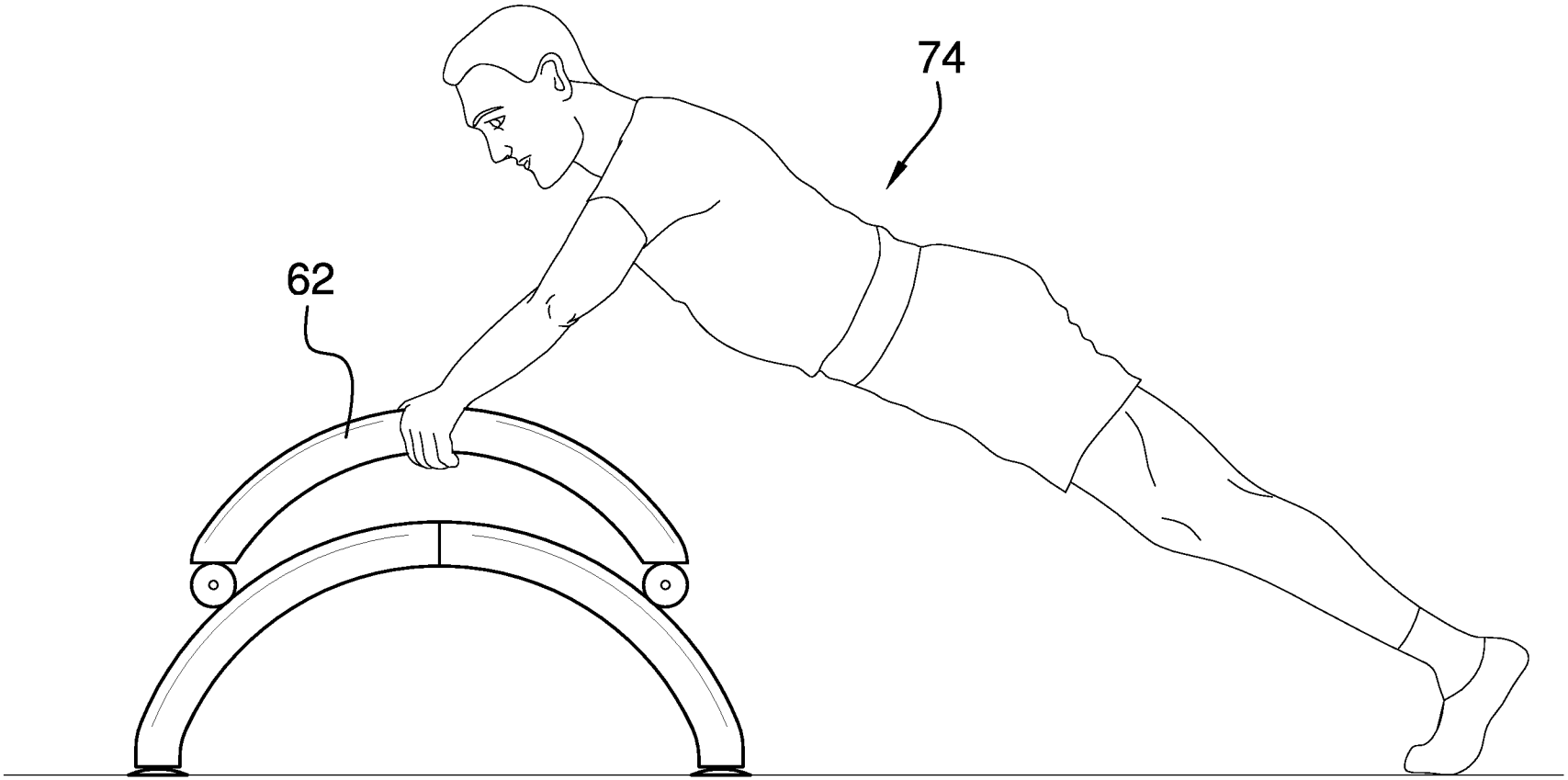
FIG. 7 is a perspective in-use view of an embodiment of the disclosure.

With reference now to the drawings, and in particular to FIGS. 1 through 7 thereof, a new modular exercise device embodying the principles and concepts of an embodiment of the disclosure and generally designated by the reference numeral 10 will be described.

As best illustrated in FIGS. 1 through 7, the modular floor exercise assembly 10 generally comprises a plurality of floor supports 12 that is each removably attachable together such that the plurality of floor supports 12 forms a bridge-like structure. Additionally, the plurality of floor supports 12 can be positioned on a support surface 14. The plurality of floor supports 12 includes a first floor support 16, a second floor support 18, a third floor support 20 and a fourth floor support 22. Each of the first floor support 16, the second floor support 18, the third floor support 20 and the fourth floor support 22 comprise a curved member 24 that has a first end 26, a second end 28 and an outer surface 30 extending therebetween. The curved member 24 is arcuate between the first end 26 and the second end 28, and the first end 26 has a foot 32 coupled thereto to rest on the support surface 14.

The second end 28 of the curved member 24 associated with the first floor support 16 and the third floor support 20 has a pin 34 extending away therefrom. Additionally, the second end 28 of the curved member 24 associated with the second floor support 18 and the fourth floor support 22 has a well 36 extending inwardly therein. The pin 34 on the curved member 24 associated with the first floor support 16 and the third floor support 20 engages the well 36 in the curved member 24 associated with a respective one of the second floor support 18 and the fourth floor support 22. Moreover, the curved member 24 associated with each of the first floor support 16 and the second floor support 18 forms an arch that curves upwardly from the support surface 14. Additionally, the curved member 24 associated with each of the third floor support 20 and the fourth floor support 22 forms an arch that curves upwardly from the support surface 14.

Each of the first floor support 16, the second floor support 18, the third floor support 20 and the fourth floor support 22 includes an elongate member 38 that has a primary end 40, a secondary end 42 and an exterior surface 44 extending therebetween. The exterior surface 44 is coupled to the outer surface 30 of the curved member 24 and the elongate member 38 is oriented to extend along an axis that is oriented perpendicular to an axis extending through the first end 26 and the second end 28 of the curved member 24. The elongate member 38 is centrally positioned between the first end 26 and the second end 28, and the elongate member 38 is attached to the curved member 24 at a point that is centrally located between the primary end 40 and the secondary end 42. The primary end 40 of the elongate member 38 has a recess 45 extending toward the secondary end 42 and the exterior surface 44 has a connecting well 46 extending inwardly therein.

The connecting well 46 in the elongate member 38 associated with the first floor support 16 and the third floor support 20 is positioned closer to the primary end 40 than the secondary end 42. The connecting well 46 in the elongate member 38 associated with the third floor support 20 and the fourth floor support 22 is positioned closer to the secondary end 42 than the primary end 40. Additionally, the secondary end 42 of the elongate member 38 associated with the third floor support 20 and the fourth floor support 22 has a recess 48 extending toward the primary end 40. The secondary end 42 of the elongate member 38 associated with the first floor support 16 and the second floor support 18 has a pin 50 extending away therefrom. The pin 50 on the elongate member 38 associated with each of the first floor support 16 and the second floor support 18 engages the recess 48 in the secondary end 42 of the elongate member 38 associated with a respective one of the third floor support 20 and the fourth floor support 22.

A plurality of support feet 52 is each removably attachable to a respective one of the floor supports 12. In this way each of the support feet 52 can abut the support surface 14 thereby inhibiting the respective floor support 12 from tipping laterally. Each of the support feet 52 has a first end 54, a second end 56 and a bend 58 that is positioned therebetween. The bend 58 is positioned closer to the first end 54 of a respective support foot 52 than the second end 56 of the respective support foot 52. The first end 54 of each of the support feet 52 has a pin 60 extending away therefrom. The pin 60 associated with each of the support feet 52 engages the recess 45 in the primary end 40 of the elongate member 38 associated with a respective one of the first floor support 16, the second floor support 18, the third floor support 20 and the fourth floor support 22. Thus, the second end 56 of each of the support feet 52 can abut the support surface 14.

A pair of cross members 62 is provided and each of the cross members 62 is removably attachable between a respective pair of the floor supports 12. Each of the cross members 62 has a first end 64 and a second end 66, and each of the cross members 62 is curved between the first end 64 and the second end 66 of the cross members 62. The first end 64 of each of the cross members 62 has a first pin 68 extending away therefrom and the second end 66 of each of the cross members 62 has a second pin 70 extending away therefrom. The first pin 68 engages the connecting well 46 in the exterior surface 44 of the elongate member 38 associated with a respective one of the first floor support 16 and the third floor support 20. Additionally, the second pin 70 engages the connecting well 46 in the exterior surface 44 of the elongate member 38 associated with a respective one of the second floor support 18 and the fourth floor support 22. Each of the cross members 62 curves upwardly between the floor supports 12 when the cross members 62 are attached thereto. In this way the user 74 can grip each of the cross members 62 for performing floor exercises.

A handle unit 72 is provided and the handle unit 72 is removably attachable to the cross members 62 when the cross members 62 are attached to the floor supports 12. In this way the handle unit 72 can be gripped by a user 74 thereby facilitating the user 74 to perform floor exercises such as a pushup or any other floor exercise. As is most clearly shown in FIG. 3, the handle unit 72 is slidable along each of the cross members 62 to facilitate the user 74 to perform the floor exercises at a variety of different angles with respect to the support surface 14. The handle unit 72 comprises a handle member 76 that has a primary end 78, a secondary end 80 and an outer surface 82 extending therebetween. Additionally, the handle member 76 is curved between the primary end 78 and the secondary end 80 of the handle member 76.

The handle unit 72 includes a pair of saddles 84 that is each coupled to a respective one of the primary end 78 and the secondary end 80 of the handle member 76. Each of the saddles 84 is concavely arcuate with respect to the respective primary end 78 and the secondary end 80 of the handle member 76. Moreover, each of the saddles 84 engages the curved member 24 of each of the floor units 12 having the handle member 76 curving upwardly from the floor units 12.

The handle unit 72 includes a pair of handles 86 that is each coupled to and extends away from the outer surface 82 of the handle member 76. Each of the handles 86 is positioned on opposite sides of a center point of the handle member 76 and each of the handles 86 has a distal end 88 with respect to the handle member 76. The handles 86 angle away from each other between the outer surface 82 of the handle member 76 and the distal end 88. A pair of handle cushions 90 is each positioned around a respective one of the handles 86. Each of the handle cushions 90 is comprised of a resiliently compressible material to enhance comfort for the user 74.

A plurality of auxiliary handles 92 is provided and each of the auxiliary handles 92 is positionable to releasably engage a respective one of the floor supports 12. In this way the auxiliary handles 92 can be gripped by the user 74 to facilitate the user 74 to perform the floor exercise with a different geometry as compared to the handle unit 72. Each of the auxiliary handles 92 has a first end 94 and a second end 96, and each of the auxiliary handles 92 has a bend 98 thereon to define a first portion 100 of forming a perpendicular angle with a second portion 102. The bend 98 on the auxiliary handles 92 is positioned closer to the first end 94 of the auxiliary handles 92 than the second end 96 of the auxiliary handles 92.

The second portion 102 has a curve 104 thereon to define a first section 106 of the second portion 102 and a second section 108 of the second portion 102 that is spaced above the first section 106. Each of the first section 106 and the second section 108 lie on a plane that is oriented perpendicular to a longitudinal axis of the first portion 100. The curve 104 is positionable around the elongate member 38 associated with the respective floor support 12 having the first portion 100 abutting the outer surface 30 of the curved member 24 associated with the respective floor support 12. In this way the second section 108 of the second portion 102 lies on a horizontal axis. Thus, the second section 108 can support the weight of the user 74 when the user 74 grips the second section 108. A plurality of auxiliary cushions 110 is provided and each of the auxiliary cushions 110 is positioned around the second section 108 of the second portion 102 of a respective one of the auxiliary handles 92. Each of the auxiliary cushions 110 is comprised of a resiliently compressible material to enhance comfort for the user 74.

In use, each of the floor supports 12 is attached together and each of the support feet 52 is attached to the floor supports 12. Each of the cross members 62 is attached to the floor supports 12 and the handle unit 72 is attached to the cross members 62. In this way the user 74 can grip each of the handles 86 on the handle unit 72 to perform floor exercises, such as pushups, planks and other floor exercises. Selected ones of the auxiliary handles 92 can be attached to the floor supports 12 to facilitate the user 74 to perform the floor exercises with a different geometry as compared to the handle unit 72. In this way the user 74 can perform the floor exercise in a variety of positions to maximize the efficiency and effectiveness of the floor exercises. Additionally, the entire assembly can be disassembled for easy storage.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular floor exercise assembly for facilitating a user to perform a variety of floor exercises, said assembly comprising:

a plurality of floor supports, each of said floor supports being removably attachable together such that said plurality of floor supports forms a bridge-like structure wherein said plurality of floor supports is configured to be positioned on a support surface;

a plurality of support feet, each of said support feet being removably attachable to a respective one of said floor supports wherein each of said support feet is configured to abut the support surface thereby inhibiting said respective floor support from tipping laterally;

a pair of cross members, each of said cross members being removably attachable between a respective pair of said floor supports;

a handle unit being removably attachable to said floor supports wherein said handle unit is configured to be gripped by the user thereby facilitating the user to perform the variety of floor exercises including a pushup, said handle unit being slidable along each of said floor supports wherein said handle unit is configured to facilitate the user to perform the variety of floor exercises at a variety of different angles with respect to the support surface; and a plurality of auxiliary handles, each of said auxiliary handles being positionable to releasably engage a respective one of said floor supports wherein each of said auxiliary handles is configured to be gripped by the user to facilitate the user to perform the variety of floor exercises with a different geometry as compared to said handle unit.

2. The assembly according to claim 1, wherein:

said plurality of floor supports includes a first floor support, a second floor support, a third floor support and a fourth floor support; and each of said first floor support, said second floor support, said third floor support and said fourth floor supports comprises a curved member having a first end, a second end and an outer surface extending therebetween, said curved member being arcuate between said first end and said second end, said first end having a foot being coupled thereto wherein said foot is configured to rest on the support surface.

3. The assembly according to claim 2, wherein:

said second end of said curved member associated with said first floor support and said third floor support has a pin extending away therefrom;

said second end of said curved member associated with said second floor support and said fourth floor support has a well extending inwardly therein; and said pin on said curved member associated with said first floor support and said third floor support engages said well in said curved member associated with a respective one of said second floor support and said fourth floor support, said curved member associated with each of said first floor support and said second floor support forms an arch wherein said arch is configured to curve upwardly from the support surface, said curved member associated with each of said third floor support and said fourth floor support forms an arch wherein said arch is configured to curve upwardly from the support surface.

4. The assembly according to claim 2, wherein each of said floor supports includes an elongate member having a primary end, a secondary end and an exterior surface extending therebetween, said exterior surface being coupled to said outer surface of said curved member, said elongate member being oriented to extend along an axis being oriented perpendicular to an axis extending through said first end and said second end of said curved member, said elongate member being centrally positioned between said first end and said second end, said elongate member being attached to said curved member at a point being centrally located between said primary end and said secondary end.

5. The assembly according to claim 4, wherein:

said primary end of said elongate member has a recess extending toward said secondary end; and said exterior surface has a connecting well extending inwardly therein.

6. The assembly according to claim 5, wherein:

said connecting well in said elongate member associated with said first floor support and said third floor support is positioned closer to said primary end than said secondary end;

said connecting well in said elongate member associated with said third floor support and said fourth floor support is positioned closer to said secondary end than said primary end.

7. The assembly according to claim 5, wherein:

said secondary end of said elongate member associated with said third floor support and said fourth floor support has a recess extending toward said primary end;

said secondary end of said elongate member associated with said first floor support and said second floor support has a pin extending away therefrom, said pin on said elongate member associated with each of said first floor support and said second floor support engages said recess in said secondary end of said elongate member associated with a respective one of said third floor support and said fourth floor support.

8. The assembly according to claim 5, wherein each of said support feet has a first end, a second end and a bend being positioned therebetween, said bend being positioned closer to said first end of a respective support foot than said second end of said respective support foot, said first end of each of said support feet having a pin extending away therefrom, said pin associated with each of said support feet engaging said recess in said primary end of said elongate member associated with a respective one of said first floor support, said second floor support, said third floor support and said fourth floor support wherein said second end of each of said support feet is configured to abut the support surface.

9. The assembly according to claim 1, wherein:

each of said cross members has a first end and a second end, each of said cross members being curved between said first end and said second end of said cross members;

said first end of each of said cross members has a first pin extending away therefrom; and said second end of each of said cross members has a second pin extending away therefrom.

10. The assembly according to claim 9, further comprising each of said floor supports includes an elongate member having a primary end, a secondary end and an exterior surface extending therebetween, said primary end of said elongate member has a recess extending toward said secondary end;

said plurality of floor supports includes a first floor support, a second floor support, a third floor support and a fourth floor support;

said first pin engages a connecting well in said exterior surface of said elongate member associated with a respective one of said first floor support and said third floor support; and said second pin engages a connecting well in said exterior surface of said elongate member associated with a respective one of said second floor support and said fourth floor support.

11. The assembly according to claim 1, wherein said handle unit comprises a handle member having a primary end, a secondary end and an outer surface extending therebetween, said handle member being curved between said primary end and said secondary end of said handle member.

12. The assembly according to claim 11, wherein said handle unit includes a pair of saddles, each of said saddles being coupled to a respective one of said primary end and said secondary end of said handle member, each of said saddles being concavely arcuate with respect to said respective primary end and said secondary end of said handle member, each of said saddles engaging a curved member of a respective one of said floor support having said handle member curving upwardly between said floor supports.

13. The assembly according to claim 11, wherein said handle unit includes a pair of handles, each of said handles being coupled to and extending away from said outer surface of said handle member, each of said handles being positioned on opposite sides of a center point of said handle member, each of said handles having a distal end with respect to said handle member, said handles angling away from each other between said outer surface of said handle member and said distal end.

14. The assembly according to claim 13, wherein said handle unit includes a pair of handle cushions, each of said handle cushions being positioned around a respective one of said handles, each of said handle cushions being comprised of a resiliently compressible material wherein each of said handle cushions is configured to enhance comfort for the user.

15. The assembly according to claim 1, wherein each of said auxiliary handles has a first end and a second end, each of said auxiliary handles having a bend thereon to define a first portion forming a perpendicular angle with a second portion, said bend on said auxiliary handles being positioned closer to said first end of said auxiliary handles than said second end of said auxiliary handles.

16. The assembly according to claim 15, wherein said second portion has a curve thereon to define a first section of said second portion and a second section of said second portion being spaced above said first section, each of said first section and said second section lying on a plane being oriented perpendicular to a longitudinal axis of said first portion.

17. The assembly according to claim 16, wherein:

each of said floor supports includes an elongate member and a curved member, said curved member having an outer surface; and said curve is positionable around said elongate member associated with said respective floor support having said first portion abutting said outer surface of said curved member associated with said respective floor support such that said second section of said second portion lies on a horizontal axis wherein said second section is configured to support a weight of the user when the user grips said second section.

18. The assembly according to claim 16, further comprising a plurality of auxiliary cushions, each of said auxiliary cushions being positioned around said second section of said second portion of a respective one of said auxiliary handles, each of said auxiliary cushions being comprised of a resiliently compressible material wherein each of said auxiliary cushions is configured to enhance comfort for the user.

19. A modular floor exercise assembly for facilitating a user to perform a variety of floor exercises, said assembly comprising:

a plurality of floor supports, each of said floor supports being removably attachable together such that said plurality of floor supports forms a bridge-like structure wherein said plurality of floor supports is configured to be positioned on a support surface, said plurality of floor supports including a first floor support, and a second floor support, a third floor support and a fourth floor support, each of said first floor support, said second floor support, said third floor support and said fourth floor supports comprising:

a curved member having a first end, a second end and an outer surface extending therebetween, said curved member being arcuate between said first end and said second end, said first end having a foot being coupled thereto wherein said foot is configured to rest on the support surface;

wherein said second end of said curved member associated with said first floor support and said third floor support has a pin extending away therefrom;

wherein said second end of said curved member associated with said second floor support and said fourth floor support has a well extending inwardly therein;

wherein said pin on said curved member associated with said first floor support and said third floor support engages said well in said curved member associated with a respective one of said second floor support and said fourth floor support, said curved member associated with each of said first floor support and said second floor support forms an arch wherein said arch is configured to curve upwardly from the support surface, said curved member associated with each of said third floor support and said fourth floor support forms an arch wherein said arch is configured to curve upwardly from the support surface;

an elongate member having a primary end, a secondary end and an exterior surface extending therebetween, said exterior surface being coupled to said outer surface of said curved member, said elongate member being oriented to extend along an axis being oriented perpendicular to an axis extending through said first end and said second end of said curved member, said elongate member being centrally positioned between said first end and said second end, said elongate member being attached to said curved member at a point being centrally located between said primary end and said secondary end, said primary end of said elongate member having a recess extending toward said secondary end, said exterior surface having a connecting well extending inwardly therein;

wherein said connecting well in said elongate member associated with said first floor support and said third floor support is positioned closer to said primary end than said secondary end;

wherein said connecting well in said elongate member associated with said third floor support and said fourth floor support is positioned closer to said secondary end than said primary end;

wherein said secondary end of said elongate member associated with said third floor support and said fourth floor support has a recess extending toward said primary end; and wherein said secondary end of said elongate member associated with said first floor support and said second floor support has a pin extending away therefrom, said pin on said elongate member associated with each of said first floor support and said second floor support engages said recess in said secondary end of said elongate member associated with a respective one of said third floor support and said fourth floor support;

a plurality of support feet, each of said support feet being removably attachable to a respective one of said floor supports wherein each of said support feet is configured to abut the support surface thereby inhibiting said respective floor support from tipping laterally, each of said support feet having a first end, a second end and a bend being positioned therebetween, said bend being positioned closer to said first end of a respective support foot than said second end of said respective support foot, said first end of each of said support feet having a pin extending away therefrom, said pin associated with each of said support feet engaging said recess in said primary end of said elongate member associated with a respective one of said first floor support, said second floor support, said third floor support and said fourth floor support wherein said second end of each of said support feet is configured to abut the support surface;

a pair of cross members, each of said cross members being removably attachable between a respective pair of said floor supports, each of said cross members having a first end and a second end, each of said cross members being curved between said first end and said second end of said cross members, said first end of each of said cross members having a first pin extending away therefrom, said second end of each of said cross members having a second pin extending away therefrom, said first pin engaging said connecting well in said exterior surface of said elongate member associated with a respective one of said first floor support and said third floor support, said second pin engaging said connecting well in said exterior surface of said elongate member associated with a respective one of said second floor support and said fourth floor support, each of said cross members curving upwardly between said floor supports when said cross members are attached thereto;

a handle unit being removably attachable to said floor supports wherein said handle unit is configured to be gripped by the user thereby facilitating the user to perform the variety of floor exercises including a pushup, said handle unit being slidable along each of said floor supports wherein said handle unit is configured to facilitate the user to perform the variety of floor exercises at a variety of different angles with respect to the support surface, said handle unit comprising:

a handle member having a primary end, a secondary end and an outer surface extending therebetween, said handle member being curved between said primary end and said secondary end of said handle member;

a pair of saddles, each of said saddles being coupled to a respective one of said primary end and said secondary end of said handle member, each of said saddles being concavely arcuate with respect to said respective primary end and said secondary end of said handle member, each of said saddles engaging said curved member of each said floor supports having said handle member curving upwardly between said floor supports;

a pair of handles, each of said handles being coupled to and extending away from said outer surface of said handle member, each of said handles being positioned on opposite sides of a center point of said handle member, each of said handles having a distal end with respect to said handle member, said handles angling away from each other between said outer surface of said handle member and said distal end; and a pair of handle cushions, each of said handle cushions being positioned around a respective one of said handles, each of said handle cushions being comprised of a resiliently compressible material wherein each of said handle cushions is configured to enhance comfort for the user;

a plurality of auxiliary handles, each of said auxiliary handles being positionable to releasably engage a respective one of said floor supports wherein each of said auxiliary handles is configured to be gripped by the user to facilitate the user to perform the variety of floor exercises with a different geometry as compared to said handle unit, each of said auxiliary handles having a first end and a second end, each of said auxiliary handles having a bend thereon to define a first portion forming a perpendicular angle with a second portion, said bend on said auxiliary handles being positioned closer to said first end of said auxiliary handles than said second end of said auxiliary handles, said second portion having a curve thereon to define a first section of said second portion and a second section of said second portion being spaced above said first section, each of said first section and said second section lying on a plane being oriented perpendicular to a longitudinal axis of said first portion, said curve being positionable around said elongate member associated with said respective floor support having said first portion abutting said outer surface of said curved member associated with said respective floor support such that said second section of said second portion lies on a horizontal axis wherein said second section is configured to support a weight of the user when the user grips said second section; and a plurality of auxiliary cushions, each of said auxiliary cushions being positioned around said second section of said second portion of a respective one of said auxiliary handles, each of said auxiliary cushions being comprised of a resiliently compressible material wherein each of said auxiliary cushions is configured to enhance comfort for the user.

* * * * *